US009184505B2

(12) United States Patent
Han et al.

(10) Patent No.: US 9,184,505 B2
(45) Date of Patent: Nov. 10, 2015

(54) DIELECTRIC CAVITY ANTENNA

(75) Inventors: Myeong Woo Han, Gyunggi-do (KR); Jung Aun Lee, Gyunggi-do (KR); Nam Heung Kim, Gyunggi-do (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 471 days.

(21) Appl. No.: 13/362,776

(22) Filed: Jan. 31, 2012

(65) Prior Publication Data

US 2013/0127669 A1 May 23, 2013

(30) Foreign Application Priority Data

Nov. 18, 2011 (KR) ..... 10-2011-0120944

(51) Int. Cl.
*H01Q 9/04* (2006.01)

(52) U.S. Cl.
CPC ..... *H01Q 9/0485* (2013.01)

(58) Field of Classification Search
CPC ..... H01Q 9/0485; H01Q 1/38; H01Q 5/0072; H01Q 9/0457; H01Q 9/045; H01Q 21/0006; H01Q 9/16; H01L 2223/6677
See application file for complete search history.

(56) References Cited

U.S. PATENT DOCUMENTS 6,028,561 A * 2/2000 Takei ..... 343/767
6,087,989 A * 7/2000 Song et al. ..... 343/700 MS
6,462,714 B1 * 10/2002 Okabe et al. ..... 343/767
6,545,641 B2 * 4/2003 Ghosh et al. ..... 343/700 MS
6,778,144 B2 * 8/2004 Anderson ..... 343/767
7,053,837 B2 * 5/2006 Il et al. ..... 343/700 MS
7,372,408 B2 * 5/2008 Gaucher et al. ..... 343/700 MS
7,518,558 B2 * 4/2009 Kato et al. ..... 343/700 MS
8,587,482 B2 * 11/2013 Liu ..... 343/700 MS
2003/0048225 A1 3/2003 Yoon
2007/0296634 A1 * 12/2007 Popugaev et al. ..... 343/700 MS
2011/0050509 A1 * 3/2011 Ayala Vazquez et al. ..... 343/702
2011/0057853 A1 * 3/2011 Kim et al. ..... 343/843
2011/0133993 A1 * 6/2011 Utagawa et al. ..... 343/700 MS
2011/0248890 A1 * 10/2011 Lee et al. ..... 343/700 MS
2013/0088396 A1 * 4/2013 Han ..... 343/700 MS
2013/0169494 A1 * 7/2013 Hung et al. ..... 343/756

FOREIGN PATENT DOCUMENTS

KR 10-2001-0000050 A 1/2001
KR 2003-0023109 3/2003
KR 10-0706615 B1 4/2007
KR 2010-0041608 A1 4/2010

* cited by examiner

*Primary Examiner* — Trinh Dinh
(74) *Attorney, Agent, or Firm* — NSIP Law

(57) ABSTRACT

There is provided a dielectric cavity antenna including: a multilayer substrate having an opening formed in at least a portion of a predetermined surface thereof; a dielectric cavity inserted into the multilayer substrate to radiate an electromagnetic wave signal through the opening; a feed line feeding power to the dielectric cavity; and at least one metal pattern formed in an inner portion of the dielectric cavity or on a surface thereof to thereby be electromagnetically coupled to the feed line.

13 Claims, 5 Drawing Sheets

DIELECTRIC CAVITY ANTENNA

CROSS-REFERENCE TO RELATED APPLICATIONS

This application claims the priority of Korean Patent Application No. 10-2011-0120944 filed on Nov. 18, 2011, in the Korean Intellectual Property Office, the disclosure of which is incorporated herein by reference.

BACKGROUND OF THE INVENTION

1. Field of the Invention

The present invention relates to a dielectric cavity antenna having a reduced size without a change in a bandwidth or a resonance frequency by using reactance characteristics of a metal pattern.

2. Description of the Related Art

Recently, research into a near field communications transceiver for transmitting mass data, such as the next generation WiFi of 2.4 GHz/5 GHz, WPAN of 60 GHz, and an integrated solution in which WiFi and 60 GHz are combined, has been actively conducted both domestically and internationally. In the 60 GHz band, a relatively wide bandwidth of several GHz may be used without a license. Therefore, interest in a mass data transmission system application, using the 60 GHz band, and providing audio, video, and data services, as well as a simple audio service, has increased. In order to provide these various services, a size of a system module needs to be increased. Therefore, there is a need to reduce a size of an antenna in order to reduce the size of the system module.

SUMMARY OF THE INVENTION

An aspect of the present invention provides a dielectric cavity antenna having a reduced size without a change in a bandwidth or a resonance frequency by using reactance characteristics of a metal pattern.

According to an aspect of the present invention, there is provided a dielectric cavity antenna including: a multilayer substrate having an opening formed in at least a portion of a predetermined surface thereof; a dielectric cavity inserted into the multilayer substrate to radiate an electromagnetic wave signal through the opening; a feed line feeding power to the dielectric cavity; and at least one metal pattern formed in an inner portion of the dielectric cavity or on a surface thereof to thereby be electromagnetically coupled to the feed line.

The metal pattern electromagnetically coupled to the feed line is changed, such that impedance formed by the feed line and the metal pattern may be changed.

The dielectric cavity antenna may further include a plurality of metal vias arranged along a circumference of the opening to be spaced apart from each other by predetermined intervals and vertically penetrating the multilayer substrate.

The dielectric cavity may have a rectangular parallelepiped shape or a cylindrical shape.

The feed line may be extended from any one layer of the multilayer substrate to the surface of the dielectric cavity or the inner portion thereof.

The feed line may be a strip line, a micro-strip line, or a coplanar waveguide (CPW) line.

The metal pattern may be spaced apart from the feed line by a predetermined interval.

A distance between the metal pattern and the opening may be smaller than a distance between the feed line and the metal pattern.

According to another aspect of the present invention, there is provided a dielectric cavity antenna including: a multilayer substrate formed by alternately laminating a plurality of dielectric layers and a plurality of conductor plates, including uppermost and lowermost layers as conductor plates, and having an opening formed in at least a portion of a predetermined surface thereof; a dielectric cavity inserted in the multilayer substrate to radiate an electromagnetic wave signal through the opening; a plurality of metal vias arranged along a circumference of the opening to be spaced apart from each other by predetermined intervals and vertically penetrating the multilayer substrate to thereby electrically connect the plurality of conductor plates to each other; a feed line feeding power to the dielectric cavity; and at least one metal pattern formed in an inner portion of the dielectric cavity or on a surface thereof to thereby be electromagnetically coupled to the feed line, wherein the plurality of metal vias determine a size of the dielectric cavity.

The metal pattern electromagnetically coupled to the feed line is changed, such that impedance formed by the feed line and the metal pattern may be changed.

The plurality of metal vias may further include an impedance determining via connecting the uppermost layer and a conductor plate among the plurality of conductor plates, the conductor plate being immediately adjacent to the uppermost layer, to each other, the impedance determining via determining impedance of the feed line.

The dielectric cavity may have a rectangular parallelepiped shape or a cylindrical shape.

The feed line may be extended from any one layer of the multilayer substrate to the surface of the dielectric cavity or the inner portion thereof.

The feed line may be a strip line, a micro-strip line, or a coplanar waveguide (CPW) line.

The metal pattern may be spaced apart from the feed line by a predetermined interval.

A distance between the metal pattern and the opening may be smaller than a distance between the feed line and the metal pattern.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
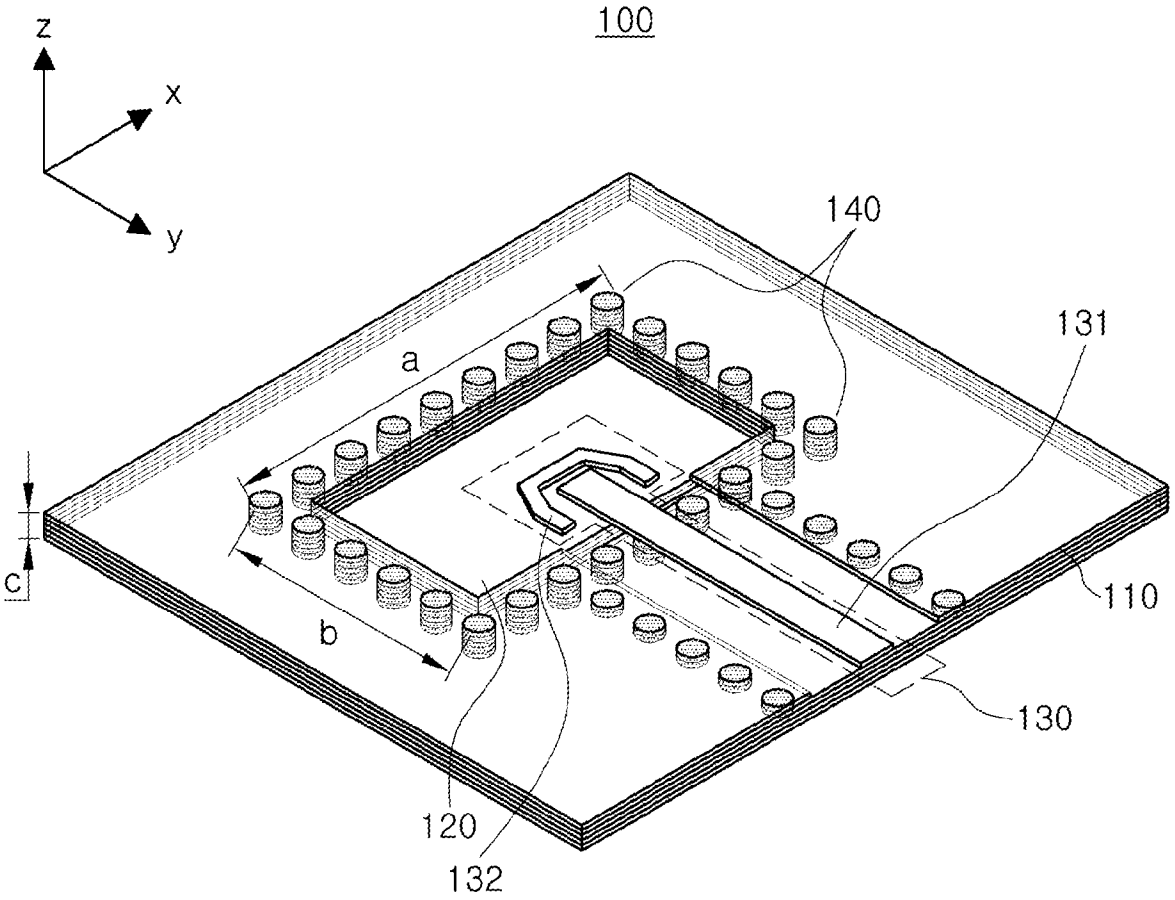
FIG. 1 is a perspective view of a dielectric cavity antenna according to an embodiment of the present invention.

Embodiments of the present invention will be described with reference to the accompanying drawings. The embodiments of the present invention may be modified in many different forms and the scope of the invention should not be limited to the embodiments set forth herein. Rather, these embodiments are provided so that this disclosure will be thorough and complete, and will fully convey the concept of the invention to those skilled in the art. In the drawings, the shapes and dimensions may be exaggerated for clarity, and the same reference numerals will be used throughout to designate the same or like components.

Figure 2:
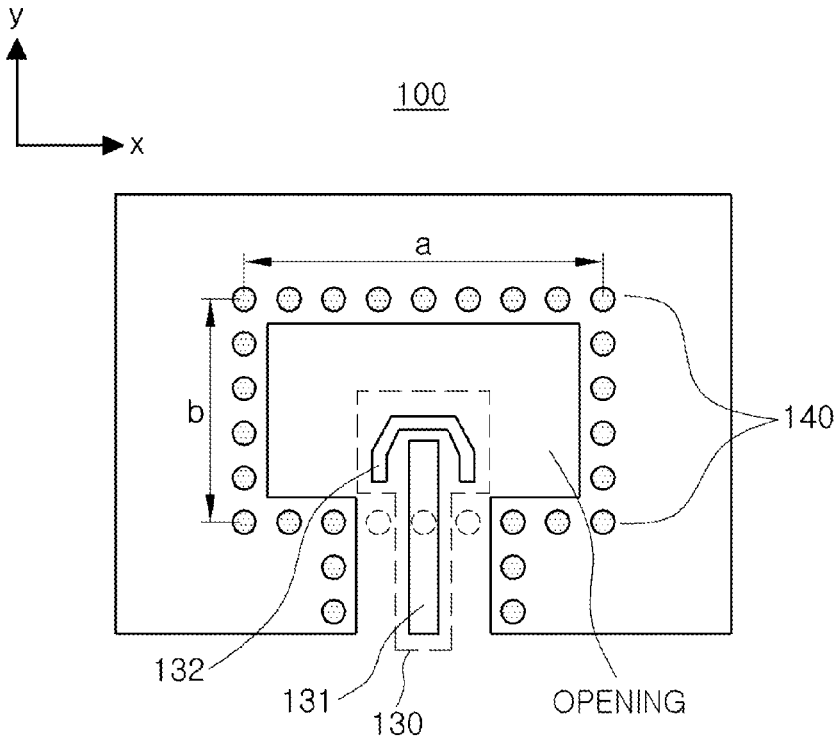
FIG. 2 is a plan view of the dielectric cavity antenna according to the embodiment of the present invention.
Figure 3A:
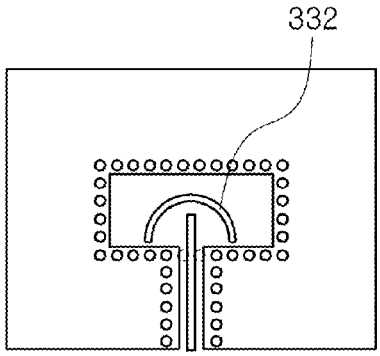
FIGS. 3A through 3D are plan views of a dielectric cavity antenna including a metal pattern according to several embodiments of the present invention.
Figure 3B:
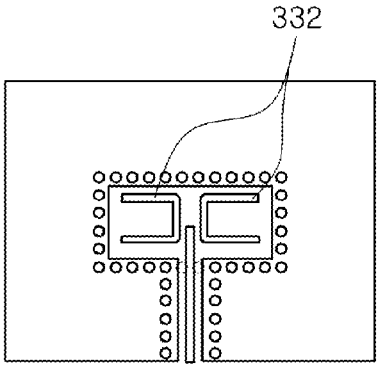
Figure 3C:
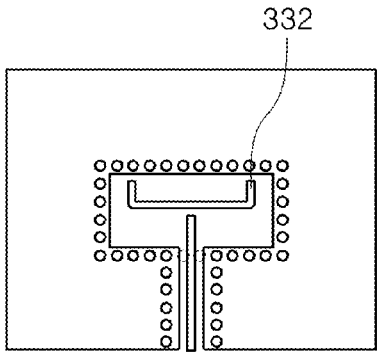
Figure 3D:
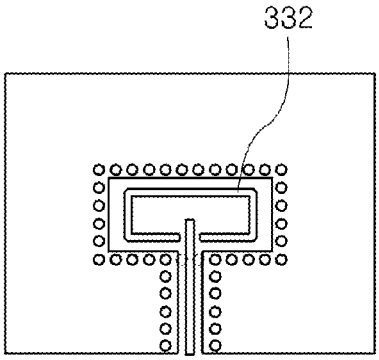

FIG. 1 is a perspective view of a dielectric cavity antenna according to an embodiment of the present invention; and FIG. 2 is a plan view of the dielectric cavity antenna according to the embodiment of the present invention.

As shown in FIGS. 1 and 2, a dielectric cavity antenna 100 according to the embodiment of the present invention may include a multilayer substrate 110, a dielectric cavity 120, and a feeder 130.

The multilayer substrate 110 may have an opening formed in at least a portion of a predetermined surface thereof. Here, the predetermined surface may be an uppermost layer. As such, the dielectric cavity antenna 100 according to the embodiment of the present invention may radiate an electromagnetic wave signal using the opening, rather than using a radiation electrode. Since the radiation electrode is not used in the dielectric cavity antenna 100 according to the embodiment of the present invention, setting a specific frequency that is to generate resonance by controlling a size of the dielectric cavity 120 to be described below, instead of a scheme of controlling a resonance frequency by controlling a length of a feed pattern may be possible. In addition, a system module including an antenna requires a structure capable of radiating generated heat to the outside. In the case of using the opening as in the present invention, the heat may be more easily radiated to the outside.

The multilayer substrate 110 may be formed of a material such as low temperature co-fired ceramic (LTCC), Rogers, Teflon, and organic based FR4, or the like. In consideration of a cost, the multilayer substrate 110 may be formed of the organic based FR4 that is relatively inexpensive. However, in order to implement excellent characteristics in a high frequency band, the multilayer substrate 110 may be formed of the LTCC.

The dielectric cavity 120 may be inserted in the multilayer substrate 110 to thereby radiate the electromagnetic wave signal through the opening. As described above, the dielectric cavity antenna 100 according to the embodiment of the present invention has a structure in which a dielectric is integrated in a substrate rather than a structure in which the dielectric is separated from the substrate. Therefore, the dielectric cavity antenna 100 according to the embodiment of the present invention needs not to include a separate radiation pattern required in the case of the structure in which the dielectric is separated from the substrate and may be more easily manufactured in a manufacturing process.

The dielectric cavity 120 according to the embodiment of the present invention may have a rectangular parallelepiped shape as shown in FIG. 1 but is not limited thereto. That is, the dielectric cavity 120 according to the embodiment of the present invention may also have a cylindrical shape, a hemispherical shape, and other polyhedral shapes. Hereinafter, for convenience of explanation, it is assumed that the dielectric cavity 120 has a rectangular parallelepiped shape.

When it is assumed that the dielectric cavity antenna 100 according to the embodiment of the present invention operates in a signal resonance mode, a resonance frequency of the dielectric cavity antenna 100, that is, a resonance frequency of the radiated electromagnetic wave signal may be determined by the following Equation 1. In Equation 1, a indicates a length of the dielectric cavity 120 in an x direction, and c indicate a thickness of the multilayer substrate 110.

$$f = \frac{c}{2\pi\sqrt{(\varepsilon_r)}}\sqrt{\left(\frac{\pi}{a}\right)^2 + \left(\frac{\pi}{2c}\right)^2} \quad \text{[Equation 1]}$$

According to Equation 1, when the length a of the dielectric cavity 120 in the x direction increases, the resonance frequency decreases. On the other hand, when the length a of the dielectric cavity 120 in the x direction decreases, the resonance frequency increases. Likewise, when the thickness c of the multilayer substrate 110 increases, the resonance frequency decreases, and when the thickness c of the multilayer substrate 110 decreases, the resonance frequency increases. That is, in the single resonance mode, the resonance frequency of the radiated electromagnetic wave signal is determined according to the lengths a and c. In addition, a bandwidth of the antenna may be improved by controlling a length b of the dielectric cavity 120 in a y direction. As described above, in the case in which the dielectric cavity 120 having the rectangular parallelepiped shape is used, there are several usable design parameters.

In addition, according to Equation 1, in order to obtain a low frequency as the resonance frequency, the length a of the dielectric cavity 120 in the x direction or the thickness c of the multilayer substrate 110 need to be significantly increased. However, the thickness of the multilayer substrate 110 in the antenna may not be increased to a desired thickness due to a limitation in an antenna manufacturing process, or the like. Consequently, in order to radiate a low frequency signal, the length a of the dielectric cavity 120 in the x direction needs to be increased. That is, in order to obtain the low frequency as the resonance frequency, a size of the dielectric cavity 120 needs to be increased and as a result, the entire size of the dielectric cavity antenna 100 needs to be increased. In order to solve the defect, a metal pattern 132 to be described later, is included in the feeder 130 of the dielectric cavity antenna 100 according to the embodiment of the present invention.

The feeder 130, a component connecting a transceiver, or the like, (not shown in FIG. 1) and the dielectric cavity antenna 100 to each other to thereby transmit high frequency power, may include a feed line 131 and the metal pattern 132.

The feed line 131, a component for feeding power to the dielectric cavity 120, may have a characteristic impedance determined by an impedance determining via 443 to be described below. The feed line 131 may be extended from any one layer of the multilayer substrate 110 to a surface of the dielectric cavity 120 or an inner portion thereof and be formed of a conductor plate having a line shape. In addition, the feed line 131 may be a strip line, a micro-strip line, or a coplanar waveguide (CPW) line. Particularly, in the dielectric cavity antenna 100 according to the embodiment of the present invention, a first conductor plate 411*a* of the dielectric cavity antenna 100 to be described below, that is, a micro-strip line formed on the uppermost layer of the multilayer substrate 110 may be used as the feed line 131.

The metal pattern 132 has a predetermined reactance, and may be formed in the inner portion of the dielectric cavity 120 or on the surface thereof and be electromagnetically coupled to the feed line 131. That is, a position of the metal pattern 132 is not limited. Therefore, even in the case in which the metal pattern 132 is positioned on any portion of the surface or the center of the dielectric cavity 120, an effect of the present invention to be described below may be accomplished. In addition, the metal pattern 132 may be positioned on the same layer as a layer on which the feed line 131 is positioned or be positioned on a layer different from the layer on which the feed line 131 is positioned. Particularly, the metal pattern 132 may be positioned on a layer higher than that of the feed line 131, that is, a distance between the metal pattern 132 and the opening may be smaller than a distance between the feed line 131 and the metal pattern 132. Further, the metal pattern 132 may be spaced apart from the feed line 131 by a predetermined interval. However, the metal pattern 132 may also contact the feed line 131.

As in the dielectric cavity antenna 100 according to the embodiment of the present invention, in a case in which the metal pattern 132 is included in the antenna, the single resonance mode of the dielectric cavity 120 and the reactance characteristics of the metal pattern 132 are combined with each other, such that the resonance frequency moves to a low frequency. That is, the metal pattern 132 is included in the feeder 130, such that impedance and a resonance frequency of the feeder 130 are changed due to an electromagnetic coupling effect between the feed line 131 and the metal pattern 132, thereby changing the resonance frequency to a lower frequency. In addition, since a shape of the metal pattern 132 is not limited, the metal pattern 132 electromagnetically coupled to the feed line 131 is changed, whereby impedance formed by the feed line 131 and the metal pattern 132 may be changed.

In this case, in order to move the resonance frequency having moved to a lower frequency to a center frequency, the length a of the dielectric cavity 120 in the x direction needs to decrease. Therefore, the length a of the dielectric cavity 120 in the x direction required in order to obtain a low resonance frequency may reduced as compared to a case in which the metal pattern 132 is not included. As a result, the dielectric cavity antenna 100 having a reduced size without a change in characteristics thereof may be obtained. The dielectric cavity antenna 100 according to the embodiment of the present invention may have a size reduced by about 14%, as compared to a dielectric cavity antenna that does not include the metal pattern 132 therein.

For example, the dielectric cavity antenna 100 used in a system module operating in the 60 GHz band needs to have a resonance frequency of 60 GHz. It may be regarded that in the dielectric cavity antenna 100, 50Ω matching is performed in 60 GHz. When the length a of the dielectric cavity antenna 100 in the x direction decreases, the resonance frequency increases according to Equation 1, which may be interpreted that in the dielectric cavity antenna 100, 50Ω matching is no longer performed in 60 GHz but may be performed, for example, in 63 GHz. Here, when the metal pattern 132 is included as in the embodiment of the present invention, the impedance of the feeder 130 is changed as described above, 50Ω matching is performed in 60 GHz again, rather than being performed in 63 GHz. As a result, according to the embodiment of the present invention, a size-reduced antenna in which 50Ω matching is performed in the same frequency may be obtained. In addition, the dielectric cavity antenna 100 according to the embodiment of the present invention may have other resonance frequencies as well as 60 GHz described above, and even in this case, the size of the antenna size may be reduced through the inclusion of the metal pattern 132.

The dielectric cavity antenna 100 according to the embodiment of the present invention may include a plurality of metal vias 140. The plurality of metal vias 140 may be arranged along a circumference of the opening to be spaced apart from each other by predetermined intervals and vertically penetrate the multilayer substrate 110. The dielectric cavity antenna 100 ideally requires a metal boundary surface formed in a direction perpendicular to the multilayer substrate 110. However, it is practically difficult to form the metal boundary surface in the direction perpendicular to the multilayer substrate 110, in a general substrate lamination process. Therefore, in the dielectric cavity antenna 100 according to the embodiment of the present invention, the plurality of metal visas 140 arranged along the circumference of the opening to be spaced apart from each other by predetermined intervals are used, instead of the metal boundary surface formed in the direction perpendicular to the multilayer substrate 110. Therefore, the dielectric cavity 120 is embedded in the multilayer substrate 110 by the plurality of metal vias 140 in such a manner that only the opening is opened.

FIGS. 3A through 3D are plan views of a dielectric cavity antenna including a metal pattern according to several embodiments of the present invention.

As shown in FIGS. 3A through 3D, a metal pattern 332 according to several embodiments of the present invention may have various shapes, and are not limited in a shape thereof.

Figure 4:
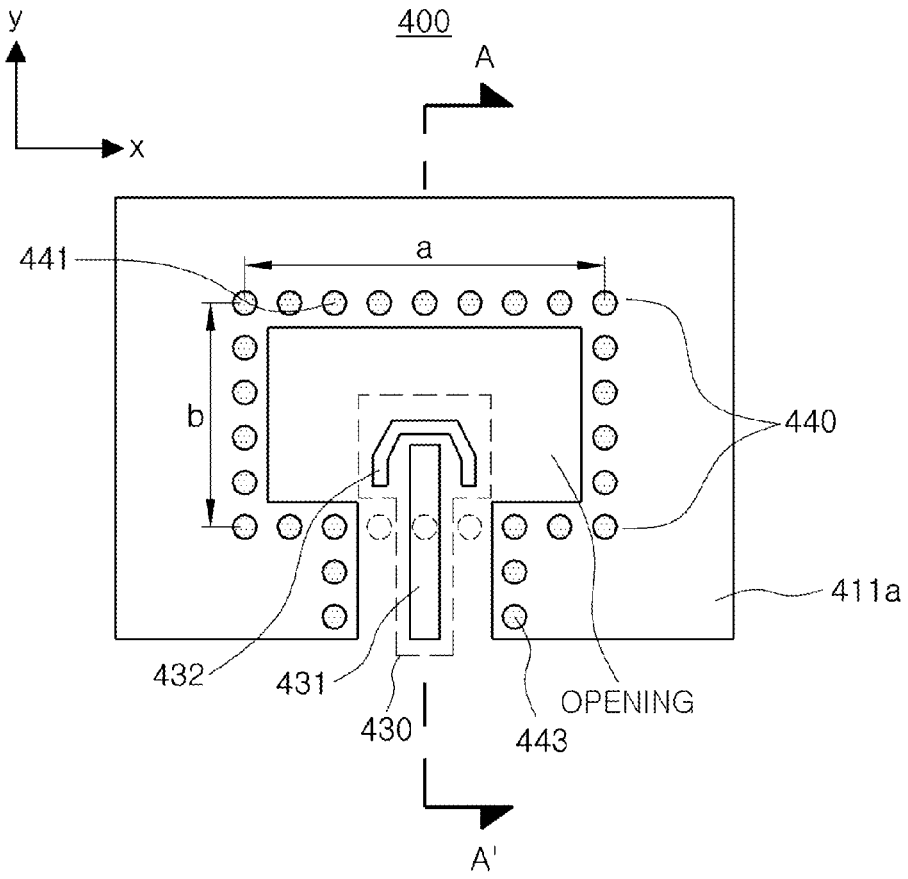
FIG. 4 is a plan view of a dielectric cavity antenna according to another embodiment of the present invention.
Figure 5:
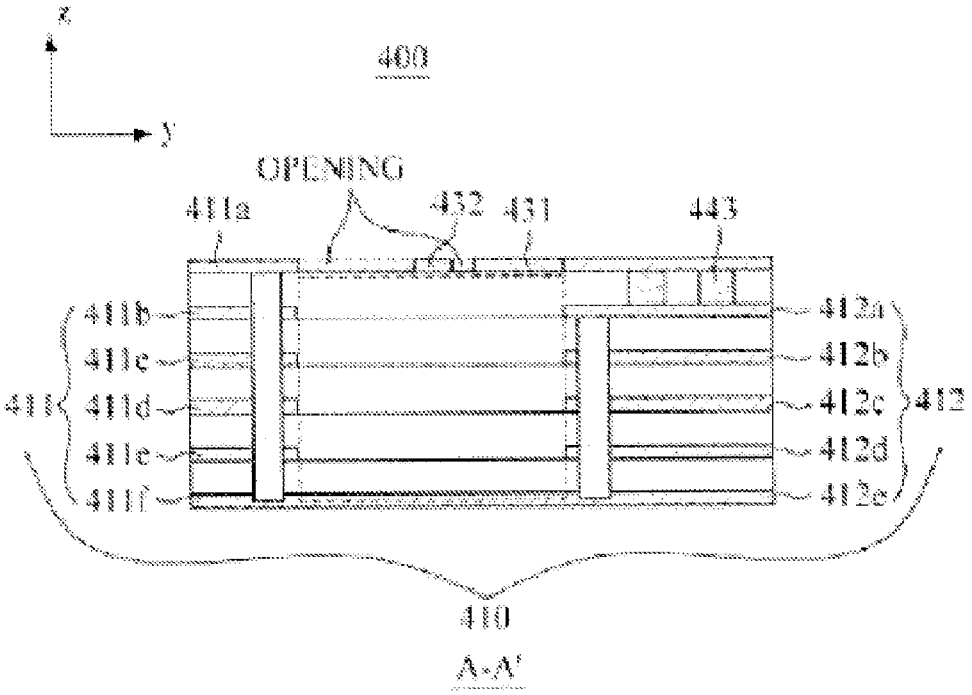
FIG. 5 is a cross-sectional view taken along line A-A' of FIG. 4.

FIG. 4 is a plan view of a dielectric cavity antenna according to another embodiment of the present invention. FIG. 5 is a cross-sectional view taken along line A-A' of FIG. 4.

In FIGS. 4 and 5 showing a dielectric cavity antenna 400 according to another embodiment of the present invention, examples of a multilayer substrate and a plurality of vias are shown in more detail. Since components of the dielectric cavity antenna according to another embodiment of the present invention except for the multilayer substrate and the plurality of metal vias, that is, a dielectric cavity and a feeder are the same as those of the dielectric cavity antenna 100 according to the embodiment of the present invention shown in FIGS. 1 and 2, a description thereof will be omitted. Therefore, hereinafter, the multilayer substrate and the plurality of metal vias will be mainly described.

As shown in FIGS. 4 and 5, the dielectric cavity antenna 400 according to another embodiment of the present invention may include a multilayer substrate 410, a plurality of metal vias 440, a dielectric cavity 420, and a feeder 430. Here, the feeder 430 may include a feed line 431 and a metal pattern 432, similar to in the dielectric cavity antenna 100 according to the embodiment of the present invention of the present invention shown in FIGS. 1 and 2.

The multilayer substrate 410 may be formed by alternately laminating a plurality of dielectric layers 412 and a plurality of conductor plates 411. The plurality of conductor plates 411 may include a first conductor plate 411*a*, a second conductor plate 411*b*, a third conductor plate 411*c*, a fourth conductor plate 411*d*, a fifth conductor plate 411*e*, and a sixth conductor plate 411*f*, and the plurality of dielectric layers 412 may include a first dielectric layer 412*a*, a second dielectric layer 412*b*, a third dielectric layer 412*c*, a fourth dielectric layer 412*d*, and a fifth dielectric layer 412*e*. Here, an uppermost layer and a lowermost layer of the multilayer substrate 410 may be conductor plates such as the first conductor plate 411*a* and the sixth conductor plate 411*f* of FIG. 5. In addition, the first conductor plate 411*a*, the uppermost layer of the multilayer substrate 410, may include an opening formed therein in order to radiate a signal.

The plurality of metal vias 440 may be arranged along a circumference of the opening to be spaced apart from each other by predetermined intervals and vertically penetrate the multilayer substrate 410 to thereby electrically connect the plurality of conductor plates to each other. The plurality of metal vias 440 may determine a size of the dielectric cavity 420, thereby determining a resonance frequency, and serve to block a signal of the dielectric cavity 420 from being leaked.

Particularly, the plurality of metal vias 440 may include a via 441 connecting the first conductor plate 411*a* and the sixth conductor plate 411*f* to each other and a via 442 connecting the second conductor plate 411*b* and the six conductor plate 411*f* to each other. Here, the first to sixth conductor plates 411*a* to 411*f* may be electrically connected to each other by the via 411 connecting the first and sixth conductor plates 411*a* and 411*f* to thereby serve as a ground.

In addition, the plurality of metal vias 440 may further include the impedance determining via 443 connecting the first and second conductor plates 411*a* and 411*b* to each other. Here, since impedance of the feed line 431 is determined by a width of the feed line 431, an interval between the feed line 431 and a ground, and heights of the feed line 431 and a ground plate, the impedance determining via 443 connecting the first and second conductor plates 411*a* and 411*b* to each other may determine the impedance of the feed line 431.

Figure 6:
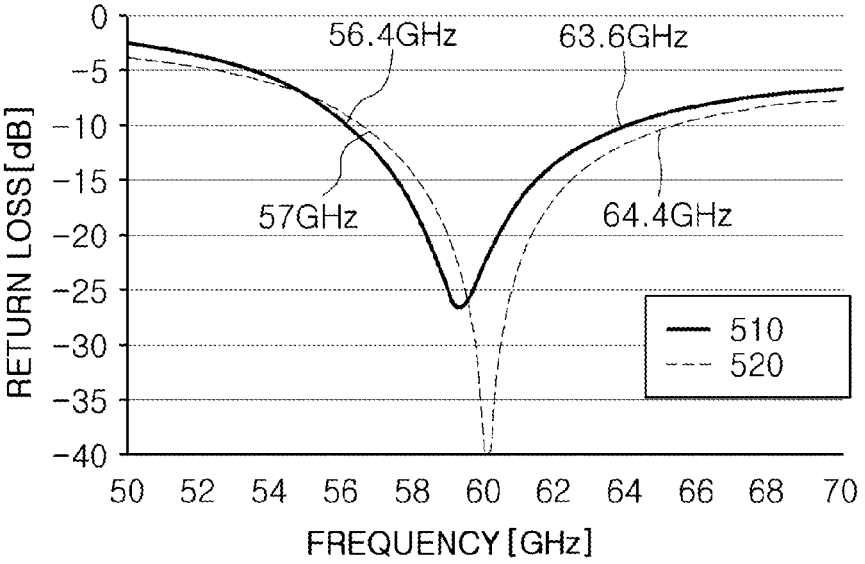
FIG. 6 is a graph showing a relationship between a return loss of the dielectric cavity antenna according to another embodiment of the present invention and a frequency.

FIG. 6 is a graph showing a relationship between a return loss of the dielectric cavity antenna according to another embodiment of the present invention and a frequency.

FIG. 6 shows changes in return loss according to frequency in a dielectric cavity antenna according to Comparative Example 510 that does not include the metal pattern and the dielectric cavity antenna 100 according to Inventive Example 520 that includes the metal pattern shown in FIG. 6. A frequency having a largest return loss value is a resonance frequency. In addition, the dielectric cavity antenna 100 according to Inventive Example 520 that includes the metal pattern has a size smaller than that of the dielectric cavity antenna according Comparative Example 510 that does not include the metal pattern by about 14%.

In the case of Comparative Example 510 denoted by a solid line, a resonance frequency has a value of about 59 to 60 GHz. In the case of Inventive Example 520 denoted by a dotted line, a resonance frequency has a value of about 60 GHz. Therefore, it could be appreciated that the dielectric cavity antenna 100 according to Inventive Example 520 that includes the metal pattern has substantially the same resonance frequency as that of the dielectric cavity antenna according to Comparative Example 510 that does not include the metal pattern.

In addition, a frequency having a return loss of −10 dB is 56.4 GHz and 63.6 GHz in the case of Comparative Example 510 and is 57 GHz and 64.4 GHz in the case of Inventive Example 520. Therefore, it could be appreciated that a bandwidth having a return loss larger than −10 dB is 7.2 GHz in the case of Comparative Example 510 and is 7.4 GHz in the case of Inventive Example 520, which are substantially the same as each other.

In conclusion, the dielectric cavity antenna 100 according to Inventive Example may be implemented to have a size smaller than that of the dielectric cavity antenna according to Comparative Example while exhibiting the same antenna performance as that of the dielectric cavity antenna according to Comparative Example that does not include the metal pattern, as described above.

As set forth above, according to the embodiments of the present invention, a size of an antenna may be reduced without a change in a bandwidth or a resonance frequency by using reactance characteristics of a metal pattern.

While the present invention has been shown and described in connection with the embodiments, it will be apparent to those skilled in the art that modifications and variations can be made without departing from the spirit and scope of the invention as defined by the appended claims.

What is claimed is:

1. A dielectric cavity antenna comprising:

a multilayer substrate having an opening formed in at least a portion of a predetermined surface of the multilayer substrate;

a dielectric cavity inserted into the multilayer substrate to radiate an electromagnetic wave signal through the opening;

a feed line feeding power to the dielectric cavity;

an impedance determining via connecting an uppermost layer and a conductor plate among the plurality of conductor plates, the conductor plate being immediately adjacent to the uppermost layer, to each other, the impedance determining via determining impedance of the feed line; and at least one metal pattern formed in an inner portion of the dielectric cavity or on a surface of the dielectric cavity to be electromagnetically coupled to the feed line, wherein the metal pattern electromagnetically coupled to the feed line is changed, such that impedance formed by the feed line and the metal pattern is changed, and the feed line and an entire portion of the at least one metal pattern are disposed on the same layer of the multilayer substrate.

2. The dielectric cavity antenna of claim 1, further comprising a plurality of metal vias arranged along a circumference of the opening to be spaced apart from each other by predetermined intervals and vertically penetrating the multilayer substrate.

3. The dielectric cavity antenna of claim 1, wherein the dielectric cavity has a rectangular parallelepiped shape or a cylindrical shape.

4. The dielectric cavity antenna of claim 1, wherein the feed line is extended from any one layer of the multilayer substrate to the surface of the dielectric cavity or the inner portion of the dielectric cavity.

5. The dielectric cavity antenna of claim 1, wherein the feed line is a strip line, a micro-strip line, or a coplanar waveguide (CPW) line.

6. The dielectric cavity antenna of claim 1, wherein the metal pattern is spaced apart from the feed line by a predetermined interval.

7. The dielectric cavity antenna of claim 1, wherein a distance between the metal pattern and the opening is smaller than a distance between the feed line and the metal pattern.

8. A dielectric cavity antenna comprising:

a multilayer substrate formed by alternately laminating a plurality of dielectric layers and a plurality of conductor plates, including uppermost and lowermost layers as conductor plates, and having an opening formed in at least a portion of a predetermined surface of the multilayer substrate;

a dielectric cavity inserted in the multilayer substrate to radiate an electromagnetic wave signal through the opening;

a plurality of metal vias arranged along a circumference of the opening to be spaced apart from each other by predetermined intervals, and vertically penetrating the multilayer substrate to electrically connect the plurality of conductor plates to each other;

a feed line feeding power to the dielectric cavity;

an impedance determining via connecting an uppermost layer and a conductor plate among the plurality of conductor plates, the conductor plate being immediately adjacent to the uppermost layer, to each other, the impedance determining via determining impedance of the feed line; and at least one metal pattern formed in an inner portion of the dielectric cavity or on a surface of the dielectric cavity to be electromagnetically coupled to the feed line, wherein the plurality of metal vias determine a size of the dielectric cavity, wherein the metal pattern electromagnetically coupled to the feed line is changed, such that impedance formed by the feed line and the metal pattern is changed, and the feed line and an entire portion of the at least one metal pattern are disposed on the same layer of the multilayer substrate.

9. The dielectric cavity antenna of claim 8, wherein the dielectric cavity has a rectangular parallelepiped shape or a cylindrical shape.

10. The dielectric cavity antenna of claim 8, wherein the feed line is extended from any one layer of the multilayer substrate to the surface of the dielectric cavity or the inner portion of the dielectric cavity.

11. The dielectric cavity antenna of claim 8, wherein the feed line is a strip line, a micro-strip line, or a CPW line.

12. The dielectric cavity antenna of claim 8, wherein the metal pattern is spaced apart from the feed line by a predetermined interval.

13. The dielectric cavity antenna of claim 8, wherein a distance between the metal pattern and the opening is smaller than a distance between the feed line and the metal pattern.

* * * * *